US009630823B1

(12) United States Patent
Conway

(10) Patent No.: US 9,630,823 B1
(45) Date of Patent: Apr. 25, 2017

(54) SAFETY GATE FOR LOADING DOCK LIFT

(71) Applicant: Mezzanine Safeti-Gates, Inc., Essex, MA (US)

(72) Inventor: Christopher J. Conway, Wilmot, NH (US)

(73) Assignee: Mezzanine Safeti-Gate, Inc., Essex, MA (US)

( * ) Notice: Subject to any disclaimer, the term of this patent is extended or adjusted under 35 U.S.C. 154(b) by 0 days.

(21) Appl. No.: 15/069,323

(22) Filed: Mar. 14, 2016

(51) Int. Cl.
*B66F 17/00* (2006.01)
*B66F 9/02* (2006.01)

(52) U.S. Cl.
CPC ..... *B66F 17/006* (2013.01); *B66F 9/02* (2013.01)

(58) Field of Classification Search
CPC ..... B66F 17/006; B66F 9/02
USPC ..... 49/236, 237, 238, 239
See application file for complete search history.

(56) References Cited

U.S. PATENT DOCUMENTS 591,687 A * 10/1897 Pettit ..... A45C 13/06 292/13
1,684,578 A 9/1928 Edward
2,086,061 A 7/1937 Barr
2,799,103 A * 7/1957 Warren ..... E05F 13/04 119/524
3,222,806 A * 12/1965 Martin ..... E05F 1/065 16/303
3,750,739 A * 8/1973 McGuire ..... E06B 3/80 160/354
3,858,357 A * 1/1975 McGuire ..... E05B 1/0015 16/86 R
4,078,334 A * 3/1978 Lambias ..... E05F 1/065 49/237
4,124,955 A * 11/1978 Kochis ..... E05F 1/065 160/354
4,285,165 A * 8/1981 Persson ..... E05F 1/065 49/238
4,292,764 A * 10/1981 Kochis ..... E05F 1/065 160/354
4,458,448 A 7/1984 Proulx
4,538,379 A 9/1985 Vargo
4,667,440 A * 5/1987 Grace, Sr. ..... E05F 1/066 49/139
5,050,344 A 9/1991 Skeem
5,133,152 A * 7/1992 Grancagnolo ..... E05D 11/04 16/312
5,615,520 A 4/1997 McGuire
8,341,888 B2 * 1/2013 Stull ..... E05F 15/614 49/237
2004/0237408 A1 12/2004 Stubbe
(Continued)

*Primary Examiner* — Jerry Redman
(74) *Attorney, Agent, or Firm* — Antoinette G. Giugliano; AGG Intellectual Property Law

(57) ABSTRACT

A safety barrier for a loading dock lift that includes a lift platform that can be raised and lowered. The safety barrier includes a sleeve attached to the lift platform extending along a vertical axis. The sleeve includes guides to define open and closed positions of said gate and said shaft includes a pin that interacts with the guides to produce rotation of said gate between open and closed positions. Consequently each embodiment gate automatically closes due to gravity whenever the lift is raised off the ground and thereby assures that that gates are locked in position when the lift platform has been raised a short distance.

6 Claims, 7 Drawing Sheets

(56) References Cited

U.S. PATENT DOCUMENTS

| | | | | |
|---|---|---|---|---|
| 2005/0005522 | A1 | 1/2005 | Benko | |
| 2008/0307709 | A1 * | 12/2008 | Stull | E05D 15/54 49/280 |

* cited by examiner

SAFETY GATE FOR LOADING DOCK LIFT

BACKGROUND OF THE INVENTION

Field of the Invention

This invention is generally directed to loading dock lifts and more specifically to safety barriers for such loading dock lifts.

Background of the Invention

Loading dock lifts have a variety of applications involving the transfer of cargo between an elevated truck bed and a depot floor. A typical loading dock lift includes a lift platform and apparatus for moving the lift platform between an upper position aligned with a truck bed and a lower position in which the lift platform is aligned with the depot floor. Cargo transfers during loading and unloading operations from the truck occur at a "front" side of the loading dock lift which is closely adjacent the truck bed. A "back" side of the lift platform is parallel to and spaced from the "front" side. When the lift platform is at a lowered position, cargo can be transferred between the depot floor and the lift platform at the back side. "Left" and "right" sides of the lift platform extend between the front and back sides of the lift platform, "left" and "right" being referenced when viewing the loading dock lifts from the back side of the lift platform toward the truck.

For purposes of this invention, "cargo" may comprise a variety of goods that have different sizes, shapes and weights. Generally speaking a lift platform is useful in elevating cargo from the depot floor to an upper level corresponding to a truck bed level to facilitate the transfer of freight onto the truck bed. That is, when freight is to be loaded onto a truck, the freight is transferred onto the lift platform over the back side at the ground or factory floor level. Then the lift platform and any cargo loaded on the lift platform elevates until the lift platform comes into an essentially coplanar alignment with the truck bed whereby cargo can transfer to the truck bed past the lift platform front side.

During an off-loading operation, an empty lift platform elevates to be in an essentially vertical alignment with the truck bed whereupon cargo can be moved from the truck bed onto the elevated lift platform past the front side. Then the loaded lift platform lowers to the factory floor level whereupon the cargo can be moved from the lift platform to the depot floor at the back side of the loading dock lift.

Personnel may ride on a loading dock lift during displacement of the lift platform. Consequently it is important that such loading dock lifts minimize the possibility of a person's sustaining an injury by making a misstep and possibly falling from the lift platform in an elevated position.

Many loading dock lifts include fixed side barriers along each side that prevent an individual from inadvertently walking off the lift platform along each side. When the upper surface of a lift platform is coplanar with the factory floor, there is little risk of personal injury by walking past the front side because the front side essentially is at the same level as the factory floor and is adjacent the truck bed. However, when the lift platform is elevated and absent a barrier across the back end of the lift platform, there is greater risk of personal injury due to a misstep because a person could fall along with the cargo being loaded on or off the truck at the back side of the lift platform.

Prior art lift platforms may include a barrier spanning the back side of the lift platform for providing protection during operations while the lift platform is being elevated or lowered or is at the elevated position. A common prior art approach uses a chain or other removable barrier that personnel attach and detach when the lift platform is lowered and attach prior to elevating the lift platform. However, such attaching and detaching steps constitute extra work that personnel may overlook while performing loading and unloading operations even recognizing that a failure to install this barrier poses a risk of injury. Consequently, such barriers along back side the lift platform still pose a risk to personnel of inadvertently walking off the lift platform while it is elevated.

SUMMARY

Therefore it is an object of this invention to provide a safety gate for a loading dock lift that provides a barrier at any time the lift platform is elevated from the factory floor.

Another object of this invention is to provide a safety gate that closes automatically without effort by personnel.

Still another object of this invention is to provide a safety gate that is economical to install In accordance with this invention a safety barrier for a loading dock lift includes a lift platform that moves between a bottom position and an upper position. The safety barrier comprises a sleeve attached to the lift platform extending along a vertical axis. A gate has a barrier attached to an upper portion of a shaft wherein a bottom portion of the shaft extends through and is rotatable within the sleeve. The sleeve includes a guide that is shaped to define open and closed positions of said gate and the shaft includes a pin at a position along the shaft that extends through the guide, wherein when a pin interacts with the guide in the closed position, the gate is closed and when the pin interacts with the guide in the open position, the gate can be opened.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
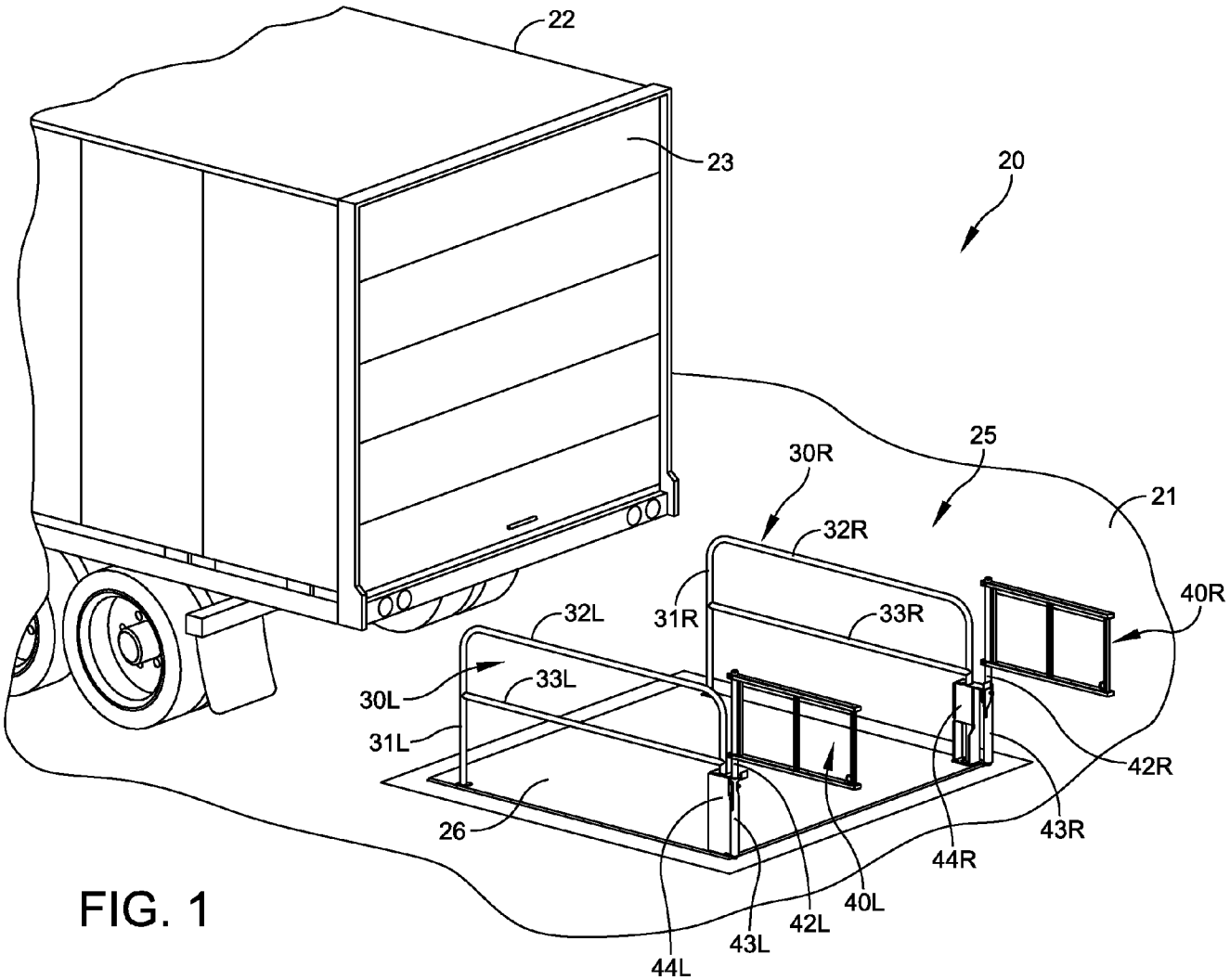
FIG. 1 depicts the relationship between a truck and a loading dock lift incorporating this invention when a lift platform in a lowered position.
Figure 2:
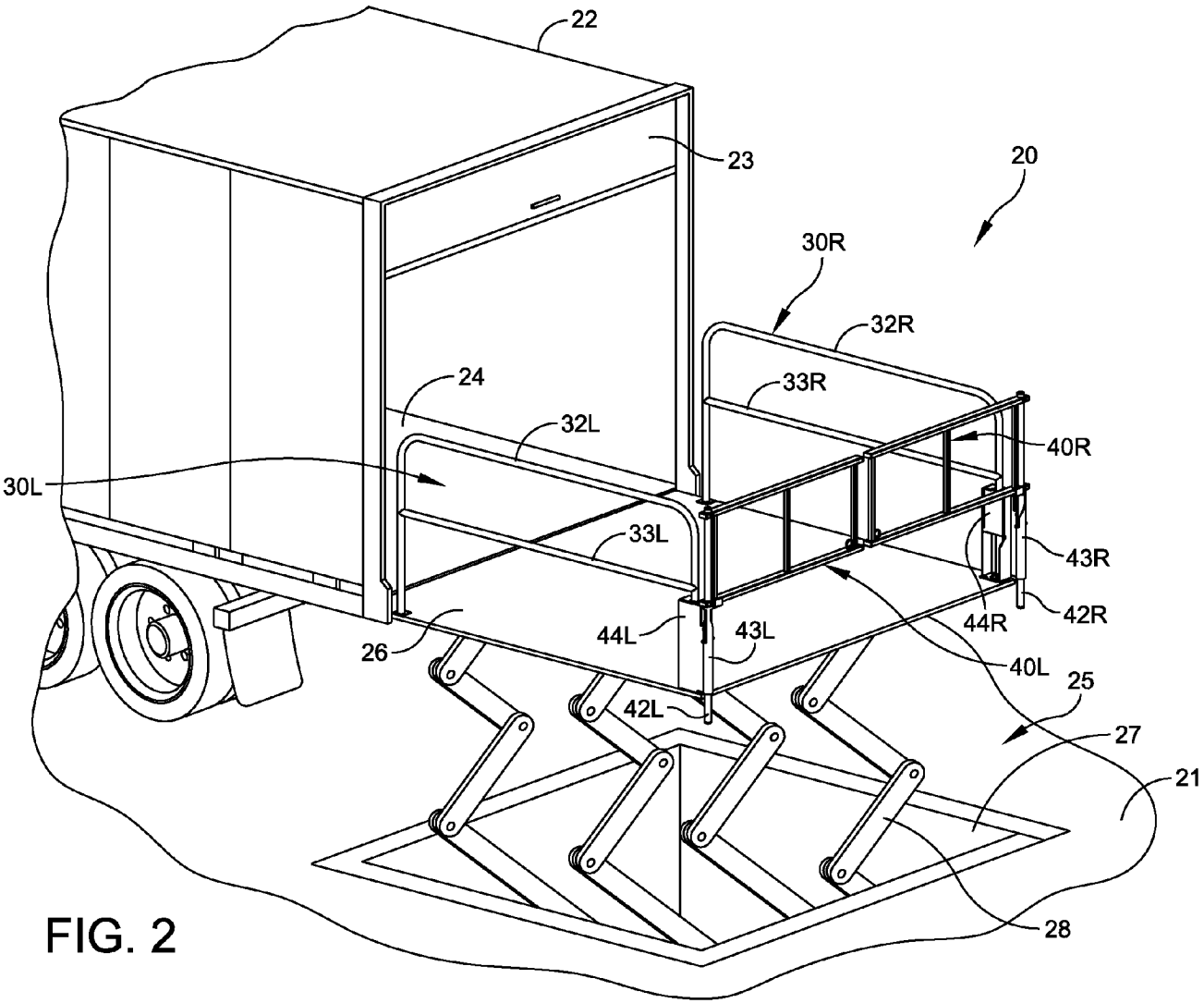
FIG. 2 depicts the relationship between the truck and loading dock lift incorporating this invention when the lift platform is in a raised position.

Each of FIGS. 1 and 2 depicts a shipping-receiving area 20 in an industrial environment. Typically this area includes a paved area or floor 21 and a truck 22 on the paved area 21. The truck 22, by way of example, has a roller type rear door 23 and a truck bed 24 above the floor 21. By way of example, the truck bed has an elevation of about 50" above the paved area 21; other heights could be substituted in other embodiments of this invention. The back of the truck bed 24 is positioned in alignment with the front side of a loading dock lift 25 that comprises a horizontal lift platform 26 and a pit 27 that houses a scissor lift 28 shown in FIG. 2 that lowers and elevates the lift platform 26. As will become apparent this invention can be applied to a variety of loading dock lifts.

The structures constituting the safety gates of this invention have similar construction except for modifications that will appear in the implementation of the left and right safety gates. In the following description it will be helpful to define a loading dock lift as having "front," "back," "left" and "right" sides. In the following description some corresponding components have the same reference numbers; however the letters "L" and "R" distinguish the components associated with the left and right safety gates, respectively. For example, FIGS. 1 and 2 depict side barriers 30L and 30R that extend along the left and right sides of the lift platform 26 at right angles to the back of the truck 22. The side barriers 30L and 30R include stanchions 31L and 31R that are affixed to the specifically disclosed loading dock lift platform 25 and include upper and lower spanning beams 32L and 33L and 32R and 33R, respectively. The embodiments of FIGS. 1 and 2 do not show a barrier structure at or near the front side of the platform (e.g., adjacent to the back of truck), spanning the lift platform between the side barriers 30L and 30R. No such barrier is required to be located between the barriers 30L and 30R at the front edge of the lift platform 26 because only a small gap will exist between the adjacent portions of the truck bed 24 and the back edge of the horizontal lift platform 26 when the lift platform 26 is elevated to its upper level.

The figures show a barrier does exist at the back side of the platform. In accordance with this invention, this barrier comprises left and right safety gates 40L and 40R that are attached to the side barriers 30L and 30R, respectively. Support shafts 42L and 42R ride in sleeves 43L and 43R respectively for axial motion of the support shafts along a vertical axis of each sleeve between an uppermost axial position of the support shafts 42L and 42R when the lift platform 26 is at the position of FIG. 1. In this position, the left and right safety gates 40L and 40R can be manually rotated between open and closed positions.

When the lift platform 26 begins to elevate, the shafts 42L and 42R remain in contact with the ground or floor 21 and undergo downward displacement relative to sleeves 43L and 43R, respectively, due to gravity. The shaft 42R interacts with the sleeve 43R to rotate the shaft 42R clockwise, when viewed from above, to close the safety gate 40L. As the lift platform 26 continues to rise, the shaft 42R lowers with respect to the sleeve 43R and the safety gate 40R is locked in a closed position. The safety gate 40L undergoes a similar process except the shaft 42L rotates counter-clockwise when viewed from above.

Figure 3:
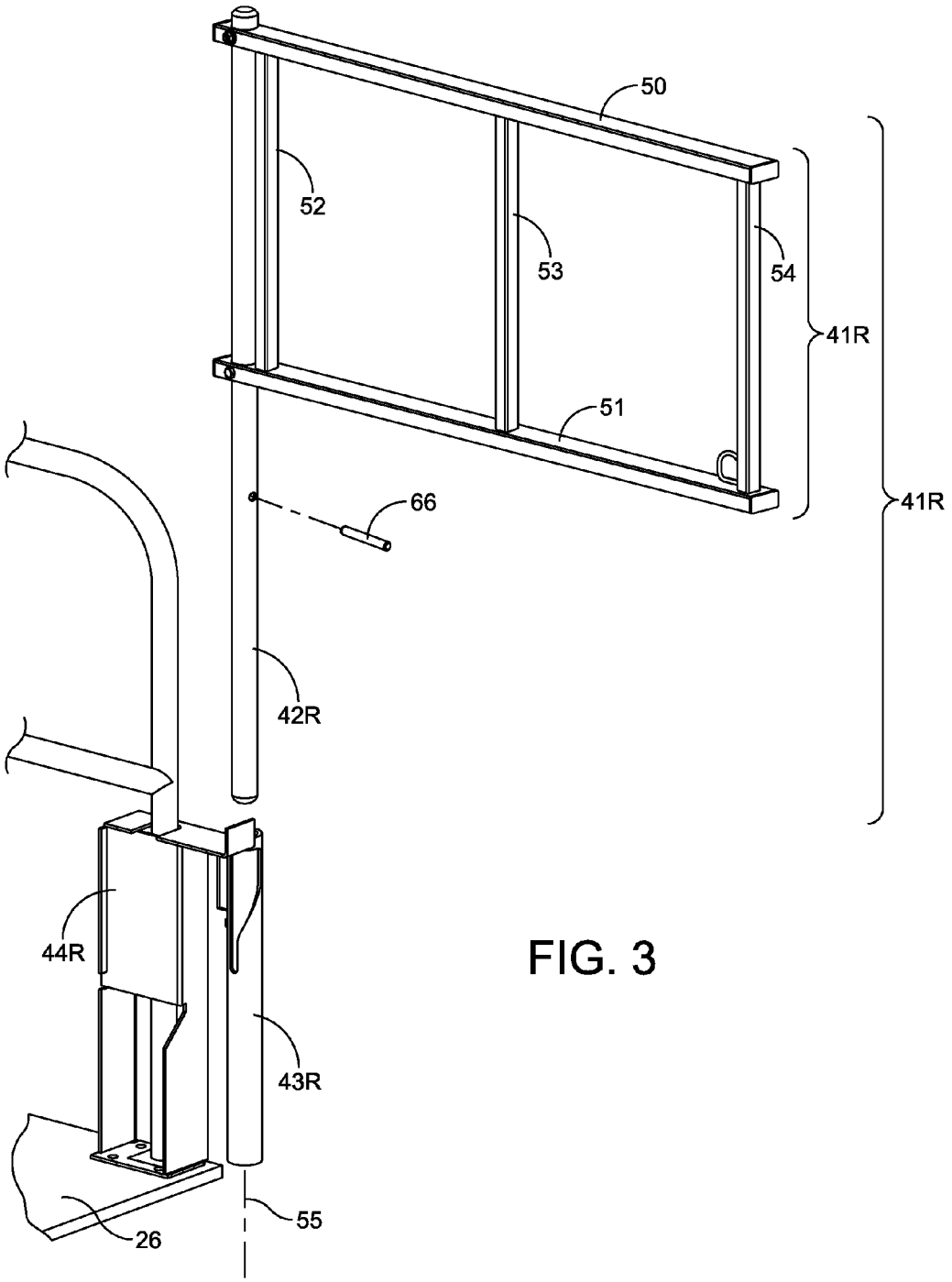
FIG. 3 is an exploded view of a safety gate that incorporates this invention.

FIG. 3 depicts the right safety gate 40R in an open position. Safety gate 40L has a similar structure with the differences being defined after discussing the structure and operation of the safety gate 40R. The gate 40R includes a barrier section 41 that, in this embodiment by way of example, comprises upper and lower horizontal beams 50 and 51 and vertical supports 52, 53 and 54 and shaft 42R. These components are positioned and welded or otherwise attached to each other and to an upper portion of the support shaft 42R. Generally, the width of this gate will be essentially half the width of the opening between the side barriers 30L and 30R in FIGS. 1 and 2.

Figure 5:
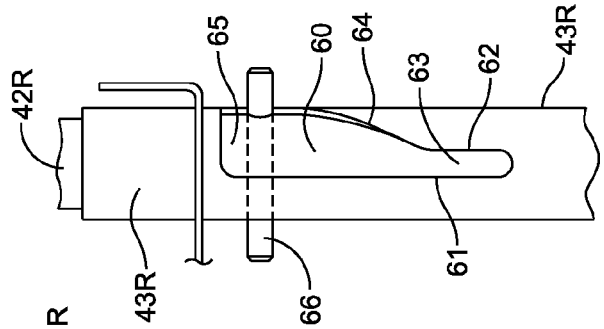
FIG. 5 is a detailed illustration of the interaction of a guide and a pin when the gate is in the open position as when the loading dock lift platform is at its lowered position.
Figure 4:
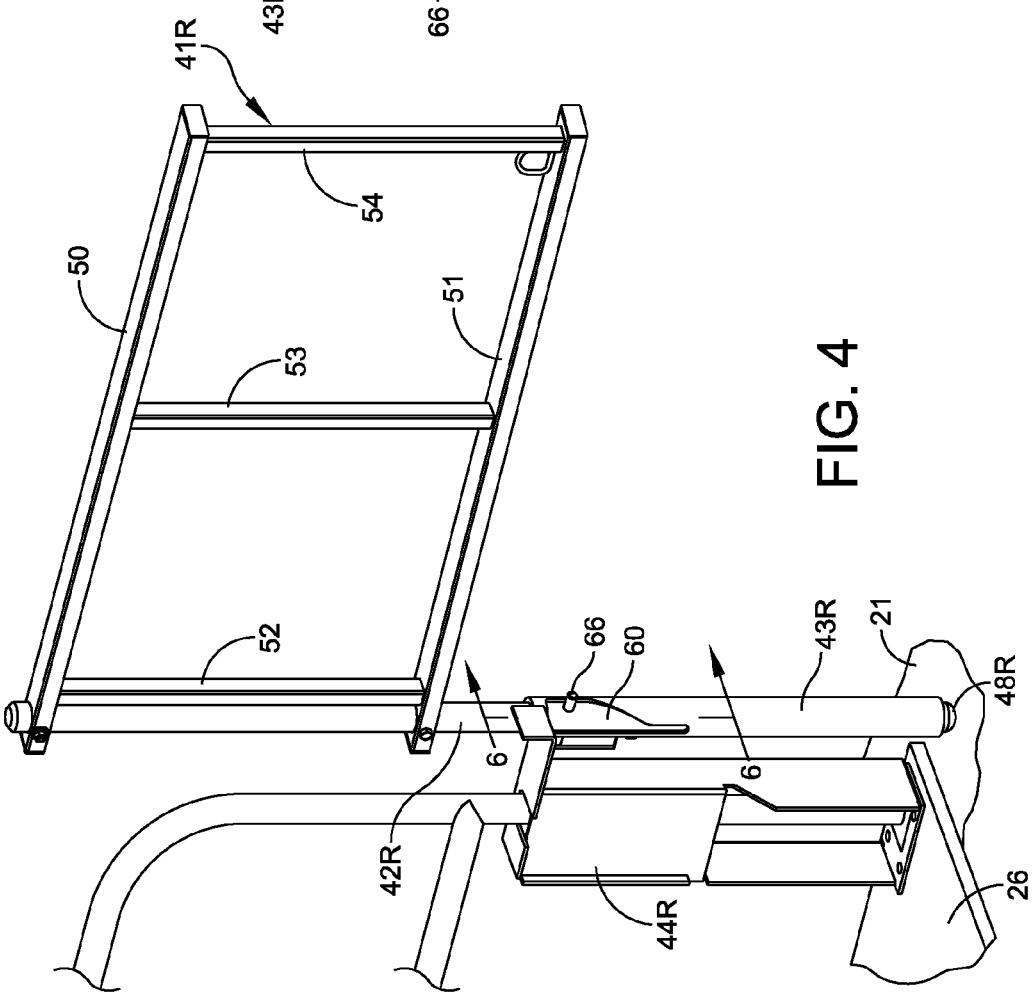
FIG. 4 is a detailed perspective view of the right safety gate of FIGS. 1 and 2 in an open position.

The lower portion of the vertical support shaft 42R extends downwardly to pass through the sleeve 43R that the bracket 44R supports in a vertical orientation. The bracket 44R also positions the sleeve 43R to be offset from the edge of the horizontal lift platform 26 such that the shaft 42R is free to slide vertically in the sleeve along an axis 55 without contacting the lift platform 26. In fact, when the gate is in the open position (e.g., the lift is in the lowered position), shaft 42R contacts the floor. When in the closed position (e.g., the lift is in the elevated position), shaft 42R slides vertically down axis 55 through sleeve 43R and the bottom of shaft 42R is not in contact with a surface and extends into the air. Referring to FIGS. 4 and 5, the sleeve 43R includes a first guide 60 in the form of a passage that has an extended vertical edge 61 and a spaced vertical edge 62 forming a bottom, vertical, axially extending channel 63. On the right side of the guide 60, an upward extension 64 of the edge 62 extends along a helical path to allow for rotating the shaft 42R about the axis 55 to define an intermediate rotation control portion and a widened portion 65.

In this embodiment, the guide 60 has a doglegged shape, but the guide can have any shape so long as it allows for vertical and rotational movement along the axis so that the gate can move from the closed position to the open position, and vice versa. Widened portion 65 or the tapered mouth (e.g., the upper portion of the dogleg) is formed by extension 62 and the top portion of vertical edge 61 and allows the user to open and close the gate because the pin 66 along with shaft 42R and barrier 41R can rotate 90° between the edges when the gate is in the open position and the lift is in the lowered position.

Figure 6:
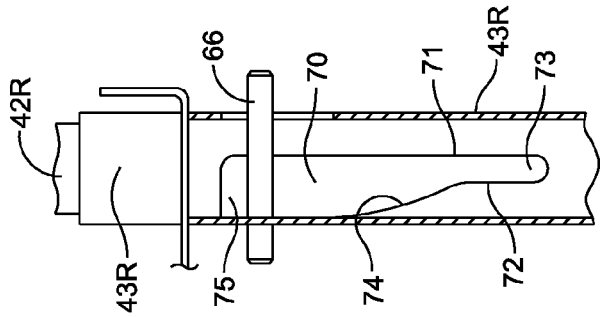
FIG. 6 is a planar sectional view of the guiding mechanism taken along lines 6-6 of the sleeve of FIG. 4.

FIG. 6 shows a second guide 70 on the opposite side of the sleeve 43R. Guide 70 is the mirror image of guide 60. Since the pin 66 extends beyond the width of sleeve 43R, a second guide mirroring the first guide exists and allows for movement of the pin on the opposite side of the sleeve. Accordingly, this guide 70 includes an extended vertical edge 71 and a spaced vertical edge 72 forming a bottom vertical channel 73. On the left side of the guide 71 an upward extension 74 forms a helical path to allow for rotation about axis 55. A widened area 75 corresponds to the widened area 65.

The first and second guides 60 and 70 are located oppositely in the sleeve 43R with the center line of the channels 63 and 73 being diametrically opposed. The pin 66 is supported by the shaft 42R and extends horizontally beyond the sleeve 43R so that the guides 60 and 70 control the angular position of the support shaft 42R.

Raising the Lift Platform

Now referring to FIGS. 4 through 6, the lift platform 26 is at its lowered position and the gate is opened. In this position, the bottom end of the shaft 42R engages the floor 21 to limit downward motion of the support shaft 42R as shown in FIG. 4. In addition, the pin 66 extends through the guides 60 and 70 in the widened portions 65 and 75. In this orientation the edges at the widened areas 65 allow for the rotation of the support shaft 42R. Consequently, the safety gate 40R can be manually swung between the open and closed positions through about 90° of rotation.

Now referring to FIGS. 4 and 5, as the platform 26 continues to rise, the support shaft 42 initially remains in contact with floor and the lift platform 26 and bracket 43R rise correspondingly with respect to the floor. As the lift platform 26 continues to rise, the shaft 42R lowers relative to the sleeve 43R and consequently pin 66 also lowers in the widened portions 65 and 75. As the lift platform continues to elevate, the pin 66 enters the intermediate position control area and will engage the helical edges 64 and 74. Further downward displacement of the support shaft 42R in the sleeve 43R as the lift platform 26 rises causes the pin 66 to engage the helical edges 64 and 74 thereby to rotate the support shaft 42R by virtue of contact between the pin 66 and the helical edges 64 and 74. The ends of the pin 66 are directed into alignment with the entrance to the vertical channels 63 and 73. Further elevation of the lift platform 26 allows the support shaft 42R to enter the channels 63 and 73. Once the pin 66 enters the channels 63 and 73, it can move vertically, but can no longer rotate. However, gravity causes pin 66 to remain in channels 63 and 73 unless manually lifted. Accordingly, when pin 66 is in channels 63 and 73 the gate is locked in a closed position.

Lowering the Lift Platform

Figure 9:
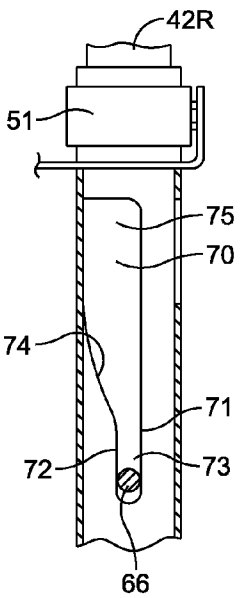
FIG. 9 is a planar sectional view of the guiding mechanism taken along line 8-8 of the sleeve of FIG. 7.
Figure 8:
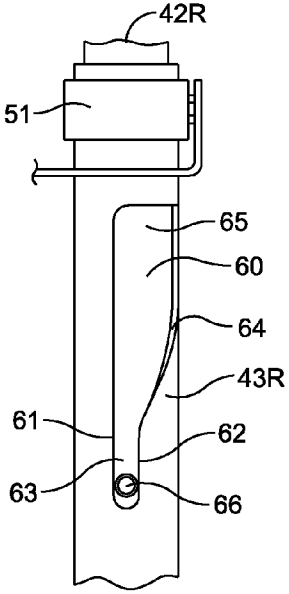
FIG. 8 is a detailed illustration of the interaction of the guide and pin when the gate is in the closed position as when the loading dock lift platform is at its elevated position)
Figure 7:
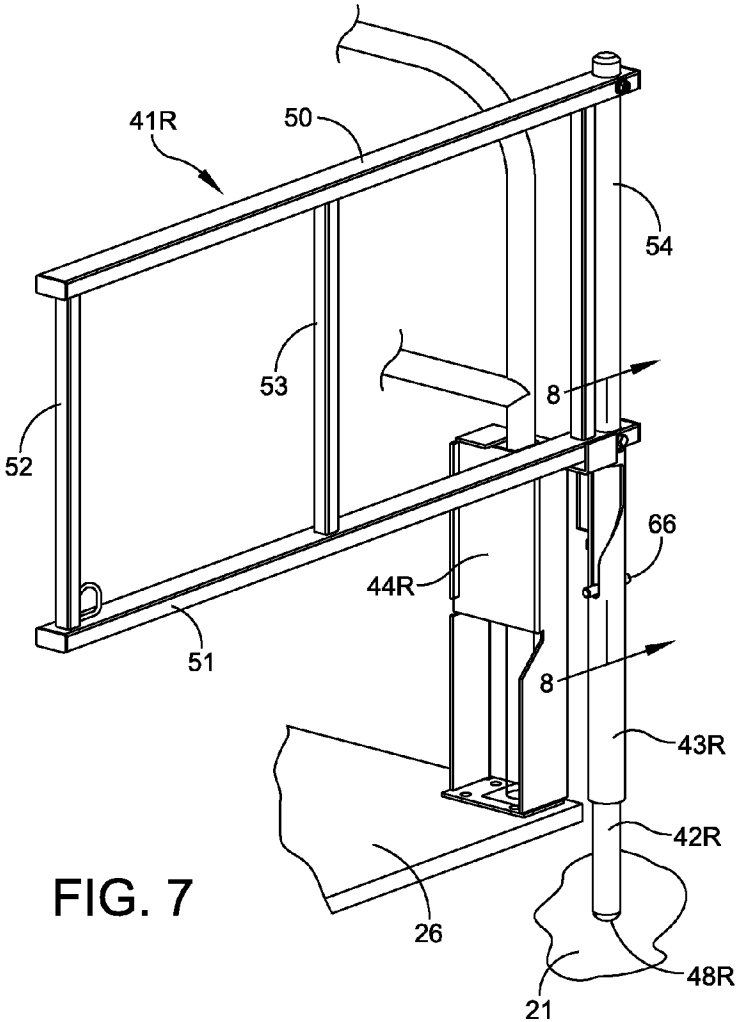
FIG. 7 is a detailed perspective view of the right safety gate of FIGS. 1 and 2 in a closed position.

FIGS. 7, 8 and 9 depict the steps that occur when the lift platform 26 is lowered from its elevated position. In the elevated position, the bottom 48R of the shaft 42R extends below the bottom of the sleeve 43R and any rotation of the safety gate 41R is blocked by the location of the pin 66 in the vertical channels 63 and 73.

As the lift platform 26 lowers to a position proximate the floor 21 whereupon, the bottom end 48R comes into contact with floor 21 and rises so that the pin 66 moves upward through the intermediate control section and into the widened areas 65 and 75. Typically the safety gate 40R remains in the closed position. Once the pin 63 is positioned in the widened areas 66 and 76, it is possible to manually pivot the barrier 40R between the closed and open positions. That is, a force applied by an individual to the barrier 40R will readily overcome any friction generated by contact between the bottom 48R and the floor 21. Consequently in this position an individual can elect to open the safety gate and close the safety gate.

ALTERNATIVE EMBODIMENT

Figure 10:
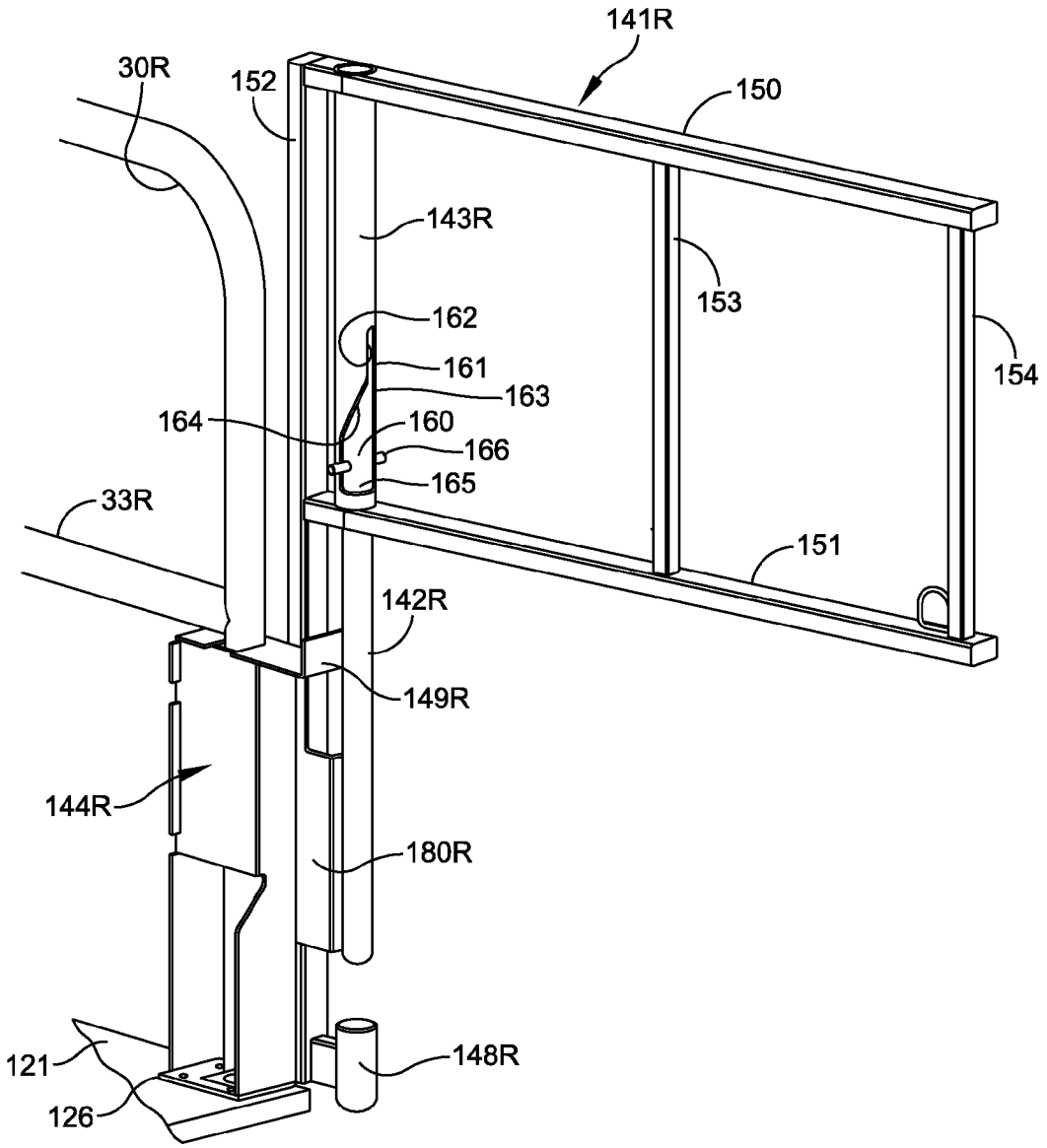
FIG. 10 depicts an alternate embodiment of this invention in an open position.
Figure 11:
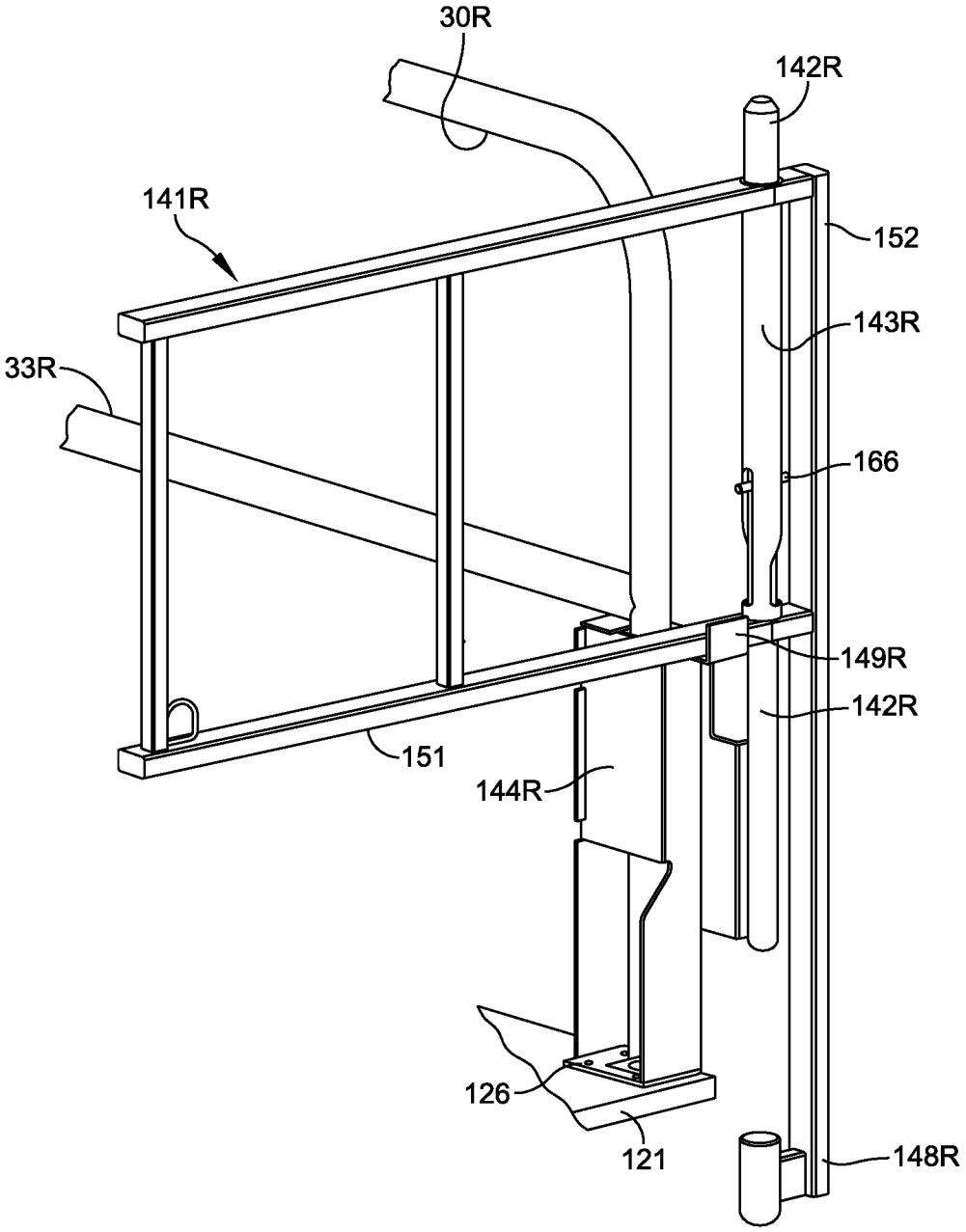
FIG. 11 depicts the alternate embodiment of this invention in a closed position.

FIGS. 10 and 11 depict an alternative embodiment of this invention. in which a mounting bracket 144R of a right gate 141R attaches to a lift platform 126 and side barrier 33R. The gate 141R comprises upper and lower horizontal beams 150 and 151, an extended stud 152 and vertical studs 153 and 154 that establish the spacing between beams 150 and 151 to establish the height of the gate 141R. The extended stud 152 attaches to the top and bottom beams 150 and 151. Below the bottom beam 151, the stud 152 forms a connector 155 that extends downwardly and terminates with a sensor 148R with an end fitting 148R that rests on the floor. When the lift platform 121 is at the position shown in FIG. 10, the end fitting 148R contacts the floor and positions the extended stud 152 at an upper position.

A sleeve 143R mounts between the beams 150 and 151 and rotates with the gate 141R about a vertical axis defined by the sleeve 143R and the extension 156R.

Still referring to FIG. 10, the sleeve 143R includes a first guide 160 in the form of a passage through the sleeve 143R that has an extended vertical edge 161 and a spaced vertical edge 162 forming an upper, vertical, axially extending channel 163. On the left side of the guide 160, an upward extension 164 of the edge 162 extends along a helical path to allow for rotating the sleeve 143R about the axis R142 about the shaft 142R thereby to define a widened portion 165 proximate the bottom of the sleeve 143R and an intermediate rotation control portion 166.

In this embodiment, the sleeve 143R will have a second guide on the opposite side of the sleeve 143R. Like the embodiment of FIGS. 1 through 9, the guide will be a mirror image of guide 160. The pin 166 is supported by the shaft 142R which does not rotate and the first and second guides 160 and 170 are located oppositely in the sleeve 143R with the center line of the channels 63 and 73 being diametrically opposed. The shaft 142R may be affixed to the bracket 143R and extend horizontally beyond the sleeve 143R so that the guides 160 and 170 control the angular position of the sleeve 143R.

As the lift platform 121 elevates from the position shown in FIG. 10, the end fitting 148R moves downward initialing causing the pin 166 to move upward relative to the sleeve 143R. Next, the pin 166 engages the edge 164 of the sleeve 143R and a corresponding edge of the guide 170. The pin 166 remains stationary so the gate 148R begins to rotate and causes the sleeve 143R to rotate thereby bringing the pin 166 into alignment with the channel 163 while the sleeve 143R undergoes vertical displacement thereby rotating the gate 141R into a closed position as shown in FIG. 11.

In this embodiment, the bracket includes a metal tab 149R. As the sleeve 143R moves downward the travel path defined by the guides 160 and 170, the vertical position of the sleeve 143R enables the gate 141R to clear the tab 149R.

As will now be apparent, the vertical displacement of the safety gate from an open position to a locked position as shown in FIG. 11 occurs over a short displacement of the lift platform 121 starting from the position in FIG. 10. For example, the lift platform 121 elevates from position of FIG. 10 about 6 inches while the overall elevation is about 72 inches.

As will now be apparent, a safety gate for a loading dock lift constructed in accordance with this invention provides a safety gate that provides a barrier at any time the lift platform is elevated from a factory floor. Closing the safety gate occurs automatically without effort by personnel while the lift platform is proximate its bottom position. Moreover, it will be apparent that such a safety gate is economical to install.

This invention has been disclosed in terms of specific embodiments. It will be apparent that a number of modifications can be made to the specifically disclosed embodiments incorporating this invention. Therefore, it is the intent of the appended claims to cover all such variations and modifications as come within the true spirit and scope of this invention.

What is claimed is:

1. A safety barrier for a lift platform that moves between a bottom position and an upper position, said safety barrier comprising:

A) a sleeve attached to the lift platform extending along a vertical axis, and

B) a gate having a barrier attached to an upper portion of a shaft wherein a bottom portion of said shaft extends through and is rotatable within said sleeve, said sleeve includes a guide that is shaped to define open and closed positions of said gate and said shaft includes a pin at a position along said shaft that extends through said guide, wherein when the pin interacts with the guide in the closed position, the gate is closed and when the pin interacts with the guide in the open position, the gate is opened as the lift platform is moved between said bottom position and said upper position.

2. The safety barrier of claim 1, wherein the shaft moves along the vertical axis when being moved from an open position to a closed position or from a closed position to an open position.

3. The safety barrier of claim 2, wherein the shaft rotates about the vertical axis when being moved from an open position to a closed position or from a closed position to an open position.

4. The safety barrier of claim 1, wherein the guide is shaped to include at least a channel through which the pin can slide into the closed position.

5. The safety barrier of claim 4, wherein the guide is shaped to further include a widened portion, continuous with the channel, into which the pin can slide into the open position.

6. The safety barrier of claim 5, wherein when the pin is in the tapered mouth of the guide, the gate can be swung into the open position by the user.

* * * * *